United States Patent [19]

Oba

[11] Patent Number: 4,709,140

[45] Date of Patent: Nov. 24, 1987

[54] HIGH SPEED LIGHT DETECTION TUBE

[75] Inventor: Koichiro Oba, Hamamatsu, Japan

[73] Assignee: Hamamatsu Photonics Kabushiki Kaisha, Hamamatsu, Japan

[21] Appl. No.: 886,440

[22] Filed: Jul. 17, 1986

[30] Foreign Application Priority Data

Oct. 18, 1985 [JP] Japan ..... 60-232745

[51] Int. Cl.[4] ..... H01J 40/14

[52] U.S. Cl. ..... 250/207; 250/213 VT; 313/527

[58] Field of Search ..... 250/213 VT, 333, 213 R, 250/207; 313/524, 525, 527, 530

[56] References Cited

U.S. PATENT DOCUMENTS 3,634,690 3/1970 Grant ..... 250/207

*Primary Examiner*—Edward P. Westin
*Assistant Examiner*—Jessica Ruoff
*Attorney, Agent, or Firm*—Spencer & Frank

[57] ABSTRACT

A high speed light detection tube consists of a planar photoelectron source of transparent type, a photoelectron collection electrode arranged in parallel with the photoelectron source and an acceleration electrode of transmission type arranged in parallel with the photoelectron source in a space between the photoelectron source and the photoelectron collection electrode. The potential distribution has been set so that the photoelectrons passing through the acceleration electrode can be incident on the photoelectron collection electrode at a constant speed or near value.

3 Claims, 6 Drawing Figures

(To: ELECTRON TRANSIT TIME)

(To: ELECTRON TRANSIT TIME)

HIGH SPEED LIGHT DETECTION TUBE

BACKGROUND OF THE INVENTION

The present invention relates to a high speed light detection tube of transmission type which is used to measure scintillation in a material due to fluorescence.

A high speed light detection tube consisting of a coaxial transmission line and a photoelectric tube is proposed and practiced to measure the light beam intensity changing at high speed. Japanese Patent Applications Laid Open No. 39429/1981 and No. 39430/1981 disclosing the high speed light detection tubes have been submitted by the assignee company of the present invention.

The high speed light detection tube appearing in each of the above laid open applications uses a photocathode of reflector type. However, the high speed detection tube with a photocathode of transmission type has already been proposed.

FIG. 1 shows a cutaway view of the high speed light detection tube with a photocathode of transmission type.

Photocathode 111 of transmission type is formed within a vacuum envelope on a surface of photocathode substrate 100 made of transparent glass.

Photoelectron collection electrode 20 is formed on the top surface of cylinder 30 made of covar metal which is arranged against the photocathode 111.

The photocathode substrate 100 is fastened to cylinder 40 made of covar metal at the top thereof.

Cylinder 30 is concentrically fastened to cylinder 40 via glass seal 51 of ring type.

Cylinder 30 is fastened to glass type 61 at the other end thereof so as to keep the envelope vacuum and holes 31 are bored throughout the side wall of cylinder 30.

Electron signal currents emitted from photocathode 111 are accelerated by the electric field formed by the potential difference between photocathode 111 and photoelectron collection electrode 20, and then collected by photoelectron collection electrode 20.

The output of photoelectron collection electrode 20 can be obtained by the electrons emitted from photocathode 111 and accelerated by the electric field formed by the potential difference between photocathode 111 and photoelectron collection electrode 20.

The distance between photocathode 111 and photoelectron collection electrode 20 is set as short as possible (i.e., 1 mm) to make the rise time of the response fast in the conventional high speed light detection tube.

The light beam incident on photocathode substrate 100 is converted into photoelectrons by photocathode 111, and said photoelectrons travel in a space of 1 mm until they are collected by photoelectron collection electrode 20.

When a bias voltage of 2000 VDC is applied to photoelectron collection electrode 20 with respect to photocathode 111, the rise time measures approximately 60 ps.

If photoelectron collection electrode 20 is arranged in parallel with photocathode 111 in the high speed light detection tube of prescribed type, the current collected by photoelectron collection electrode 20 is proportional to the speed of the photoelectrons accelerated by the electric field.

Photoelectrons emitted from photocathode 111 are continuously accelerated by the DC voltage applied to photoelectron collection electrode 20 until these photoelectrons arrive at photoelectron collection electrode 20, and thus the current responding to the photoelectrons flowing through photoelectron collection electrode 20 linearly increases with time as shown in FIG. 2. This indicates that the rise time of the output current affects the increase of the induced current.

A DC high voltage is applied to the space between photocathode 111 and photoelectron collection electrode 20 so as to reduce variations in the electron transit time while photoelectrons travel from photocathode 111 to photoelectron collection electrode 20, and the span is made as short as possible (i.e., 1 mm) in such a range that no break down can occur. However, the rise time of the response sent from the conventional ultra high speed light detection tube is at most 60 ps.

The more the rise time of the response becomes shorter, the more response signal waveform of scintillation due to fluorescence becomes sharp for measuring the life of scintillation due to fluorescence.

Recently, 60 ps in the rise time of the response from the conventional ultra high speed light detector tube is too long to measure fluorescence.

The objective of the present invention is to provide the high speed light detection tube of transmission type with faster rise time.

SUMMARY OF THE INVENTION

The high speed light detection tube in accordance with the present invention provides a planar photoelectron source of transmission type, a photoelecton collection electrode arranged in parallel with the photoelectron source, and an acceleration electrode of transmission type arranged in parallel with the photoelectron source in a space between the photoelectron source and the photoelectron collection electrode; wherein the photoelectron collection electrode and the acceleration electrode of transmission type are kept at an equal potential or near value, and a near potential to accelerate the photoelectrons passing through the space is applied to the acceleration electrode of transmission type with respect to the photocathode so that the photoelectrons passing through the acceleration electrode of transmission type can be incident on the photoelectron collection electrode at a constant speed or near value.

PREFERRED EMBODIMENT

Figure 1:
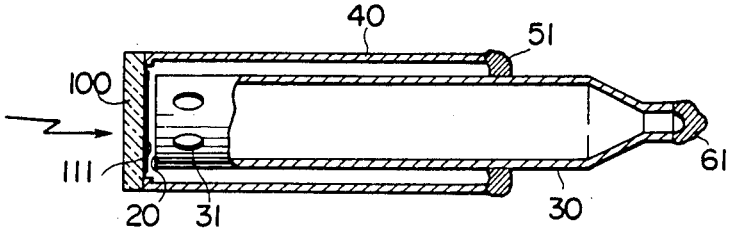
FIG. 1 shows a cutaway view of an example of the conventional high speed light detection tube of transmission type.
Figure 2:
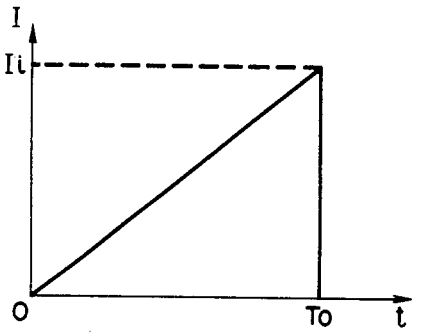
FIG. 2 shows the relation of the photoelectron collection electrode current to the electron transit time in the conventional high speed light detection tube.

The present invention will be described hereafter referring to the drawings.

Figure 3:
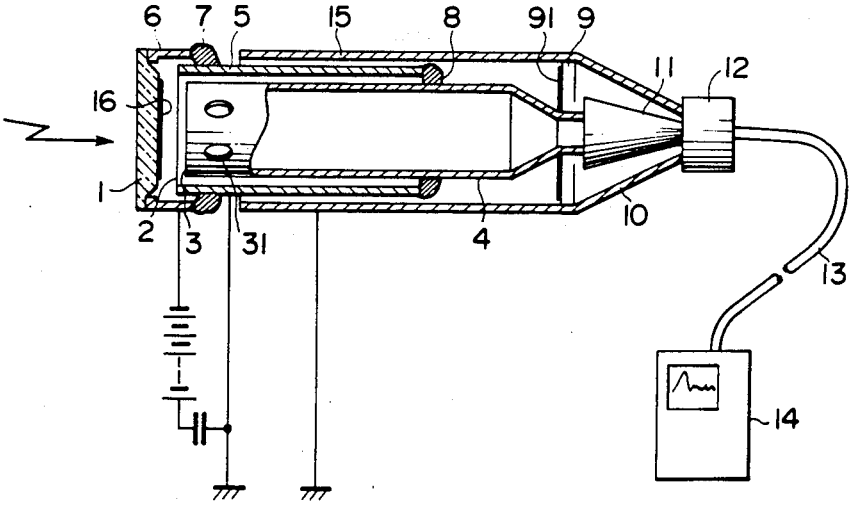
FIG. 3 shows a cutaway view of an embodiment of the high speed light detection tube of transmission type, which is cut along the plane of the tube axis, in accordance with the present invention.

FIG. 3 shows a cutaway view of an embodiment of the high speed light detection tube of transmission type, which is cut along the plane including the tube axis, in accordance with the present invention.

Disk glass plate 1 is attached to one end of cylinder 6 made of covar metal in the high speed light detection tube in accordance with the present invention.

Photocathode 16 of transmission type is formed with the vacuum envelope on a surface of the glass plate 1.

Mesh electrode 2 is fastened to one end of cylinder 5 made of covar metal in parallel with photocathode 16.

A plane at one end of cylinder 4 made of covar metal in parallel with the photocathode 16 constitutes photoelectron collection electrode 3.

Cylinder 4 is concentrically arranged with respect to cylinder 5, and the former is fastened to the latter via glass ring 8.

Cylinder 5 is concentrically arranged with respect to cylinder 6, and the former is fastened to the latter via glass ring 7.

Holes 31 are bored throughout the wall of cylinder 4.

A cone is formed in the right of ring glass seal 8 to fasten cylinder 4 to another cylinder with smaller diameter by decreasing the diameter of the cylinder 4, and another cylinder with the diameter smaller than that of cylinder 4 is formed at the right edge of the cone.

The cylinder with the diameter smaller than that of cylinder 4 is connected to metal envelope 15 via support plate 9 made of dielectric material.

Metal envelope 15 and the cylinder 5 are concentrically arranged. The inner diameter of metal envelope 15 approaches the outer diameter of cylinder 5 but the former does not contact the latter.

Resistor 91 is arranged on a surface of support plate 9 made of a dielectric material for impedance matching.

Metal envelope 15 is conically shrinked to form outer conductor 10 for the transmission line in the right of support plate 9 made of the dielectric material, and outer conductor 10 is connected to the outer conductor of coaxial connector 12.

Inner conductor 11 of conical type is connected to the cylinder with the diameter smaller than that of the cylinder 4.

Inner conductor 11 of conical type is connected to the inner conductor of coaxial connector 12 in the right thereof.

The other end of coaxial cable 13 is connected to the input terminal of oscilloscope 14.

When the input impedance of oscilloscope 14, the characteristic impedance of coaxial cable 13 and the impedance of coaxial connector 12 have the same value of 2R, the characteristic impedances at the respective junctions in the output circuit are specified as follows:

Let the characteristic impedance of conical waveguide (defined by 10 and 11) connected to coaxial connector 12 be 2R, the resistance of the resistor 91 be 2R, and the characteristic impedance of the coaxial transmission line defined by cylinder 4 as the inner condutor and by cylinder 5 or metal envelope 15 as the outer conductor be R.

If the transmission impedance parameters are defined as above, no reflection can occur in the output circuit. Thus, the ideal output circuit can be formed.

The output circuit described in detail heretofore has been explained in the specifications of the applications mentioned above and it is not directly related to the present invention.

The operation of the preferred embodiment of the high speed light detection tube in accordance with the present invention will be described hereafter.

Metal envelope 15 with the same potential as that of photoelectron collection electrode 3 is set at the reference voltage (0 V) which is the same voltage as that of mesh electrode 2.

A DC voltage in the order of thousand volts in the negative polarity is applied to cylinder 6 which is set at the same potential as photoelectron cathode 16 so that an acceleration voltage for photoelectrons can be applied to mesh electrode 2 with respect to cathode 16.

When the ultra high speed light pulse is incident on photocathode 16 passing through glass plate 1, photoelectrons are emitted from photocathode 16.

Photoelectrons travels toward mesh electrode 2 while accelerated by the potential difference between mesh electrode 2 and photocathode 16 at a DC voltage in the order of thousand volts.

A photoelectron current is induced in mesh electrode 2 but not in photoelectron collection electrode 3. The induced current cannot be observed at the output before photoelectron current passes through mesh electrode 2.

Until photoelectrons pass through mesh electrode 2 after the ultra high speed pulse light is incident on photocathode 16, the output signal cannot be observed.

The electron transit time whereat photoelectrons travel from photocathode 16 to mesh electrode 2 determines the delay time for the response of the output signal in the preferred embodiment of the high speed light detection tube. This time is constant and this causes no problem in applications.

The accelerated current arrives at mesh electrode 2 and passes through mesh electrode 2. It cannot be trapped because of high transmittance of mesh electrode 2. Most of the current travels toward photoelectron collection electrode 3 while passing through mesh electrode 2.

The accelerated current travels at constant speed until it arrives at photoelectron collection electrode 3 after passing through mesh electrode 2.

Figure 4:
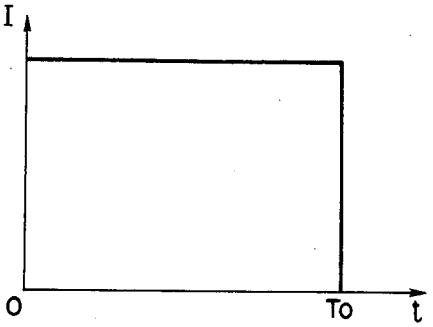
FIG. 4 shows the relation of the photoelectron collection electrode current to the electron transit time in the high speed light detection tube in accordance with the present invention.

The induced current flows through photoelectron collection electrode 3 after photoelectrons pass through mesh electrode 2. The electron velocity is constant and the rise time of the induced current is zero as shown in FIG. 4. The rise time of the detected signal depends on variations in the electron energy distribution of photoelectrons constituting the electron current.

The potential difference between mesh electrode 2 and photoelectron collection electrode 3 is zero volt, and the distance between mesh electrode 2 and photoelectron collection electrode 3 can be set at 1 mm or less. This short distance reduces variations in the electron transit time.

The electric pulse signal output from photoelectron collection electrode 3 is fed from the first coaxial transmission line with characteristic impedance R, consisting of cylinder 5 and cylinder 4, to the second coaxial transmission line with characteristic impedance 2R, consisting of outer conductor 10 and inner conductor 11, and resistor 91 with resistance 2R through the third coaxial transmission line with characteristic impedance R, consisting of metal envelope 15 and cylinder 4.

The input impedance of the parallel resonance circuit consisting of the signal line, composed of outer conductor 10 and inner conductor 11, and resistor 91 is given by R and the electric pulse signal cannot be reflected from the junction between the line and resistor 91.

The electric pulse can be fed to oscilloscope 14 with reflection.

Oscilloscope 14 has an input capacitance of 10 pF in parallel with the input resistance. Part of the ultra high speed pulse containing high frequency harmonics can be reflected from the input terminal of oscilloscope 14.

The reflected pulse signal travels along coaxial cable 13 with characteristic impedance 2R in the reverse direction and then it is absorbed or attenuated by resistor 91.

The reflected pulse signal is reflected at the junction again and then travels forwards; and it might not be displayed on oscilloscope 14 or it might not be superimposed on the pulse signal to be displayed on oscilloscope 14. Thus, the pulse signal waveform cannot be distorted.

Figure 5:
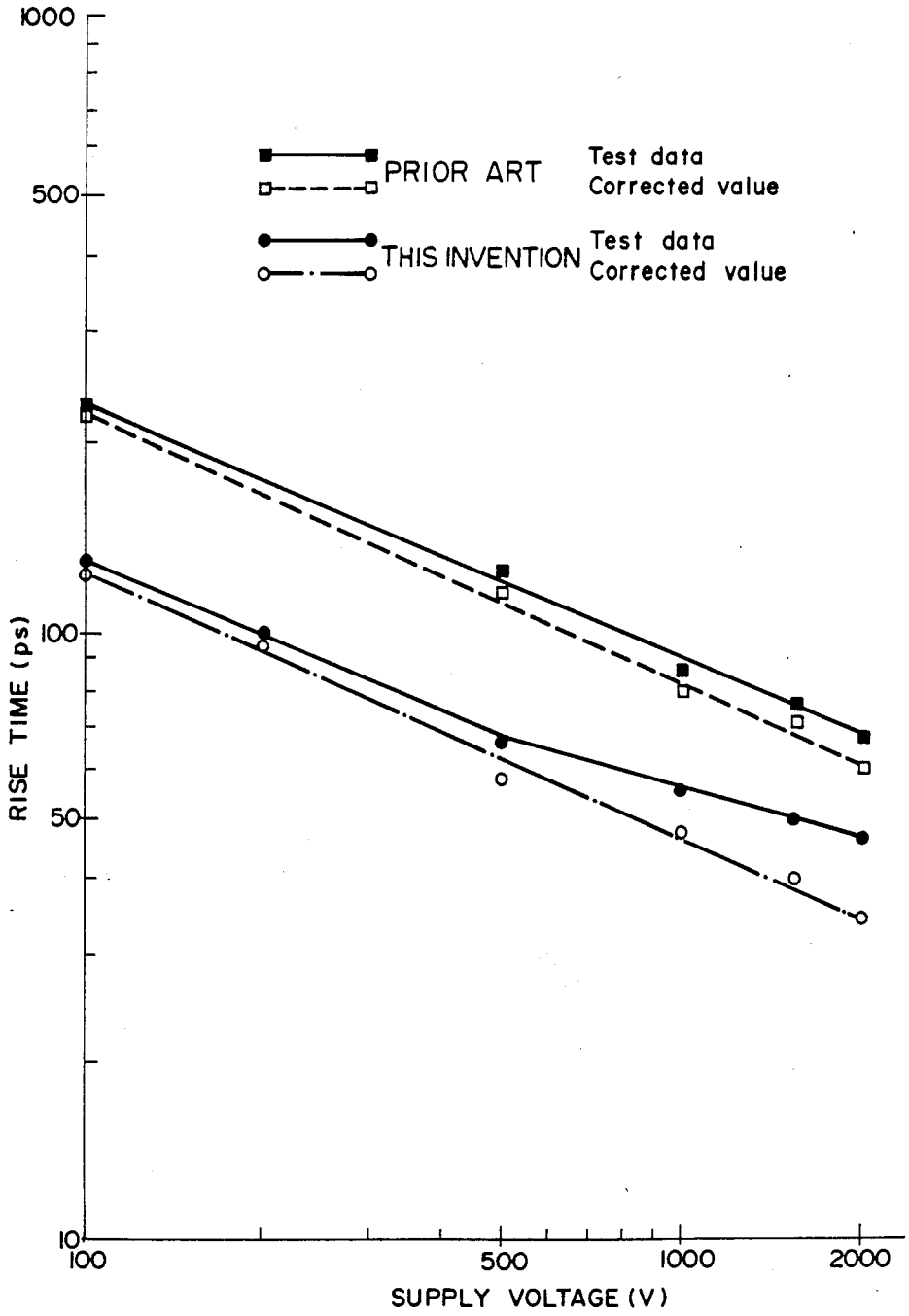
FIG. 5 shows the relation of the rise time of the response to the applied voltage in the high speed light detection tube in accordance with the present invention.

FIG. 5 shows the relation of the rise time of the response to the applied voltage in the high speed light detection tube in accordance with the present invention.

The rise time of the response from the high speed light detection time in accordance with the present invention is 55 to 70% of the rise time of the response from the conventional high speed light detection tube.

There exist a number of modifications of and variations to the embodiment of the present invention.

If the distance from the photoelectron source to the acceleration electrode of transmission type is increased when the acceleration voltage is increased in such applications that the output signal causes no problem, the rise time can be decreased furthermore.

The present invention can also be applied to the photoelectron multiplier tube wherein the microchannel plate is installed. The surface of the microchannel plate at the output is equivalent to the photocathode of the embodiment.

Figure 6:
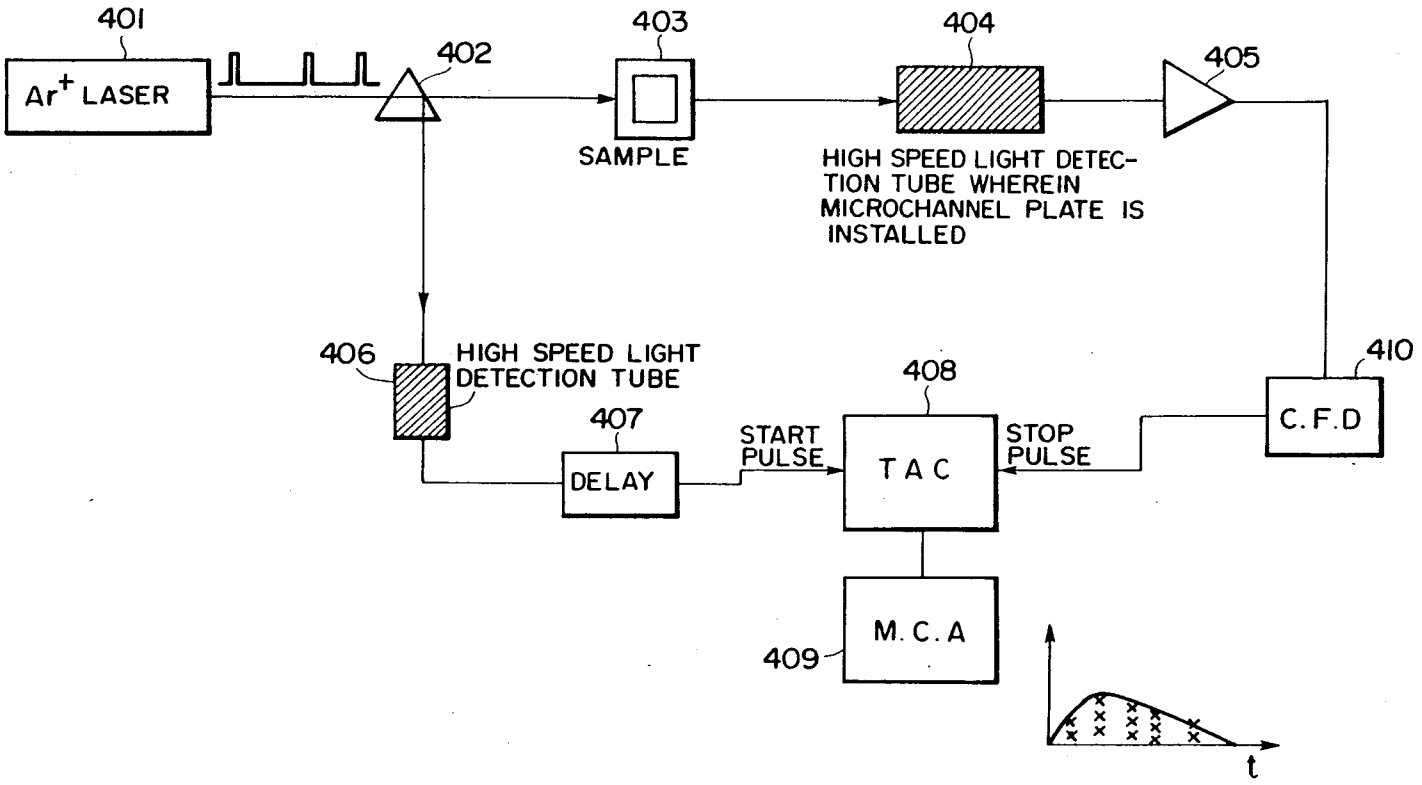
FIG. 6 shows a block diagram of the instrument for measuring the life of scintillation due to fluorescence, wherein the high speed light detection tube in accordance with the present invention is used.

FIG. 6 shows a block diagram of the instrument for measuring the life of scintillation due to fluorescence, wherein the high speed light detection tube in accordance with the present invention is installed.

A pulse train sent from Argon laser beam source 401 for use in stimulation of sample 403 is separated by light beam splitter 402. One output of light beam splitter 402 is incident on sample 403. Sample 403 emits the scintillation light due to fluorescence during the time shorter than the stimulation pulse span each time sample 403 is stimulated. The light intensity due to fluorescence is very weak and the number of photons generated each stimulus is so small that the time of scintillation cannot be estimated by each stimulus.

The light pulses generatd by the stimulus are fed to the microchannel plate installed in high speed light detection tube 404.

Photoelectrons generated by the photocathode of high speed light detection tube 404 is multiplied by microchannel plate and then fed to amplifier 405 through the coaxial transmission line.

Thereafter, the amplifier output is fed to constant fraction discriminator (CFD) 410 so as to check if a single output pulse corresponds to a single photon.

The other output of light beam splitter 402 is incident on high speed light detection tube 406 which has the same configuration as the high speed light detection tube of the embodiment.

The output of high speed light detection tube 406 or the time reference pulse for each stimulus is fed to time-to-voltage converter 408 through delay circuit 407.

Time-to-voltage converter 408 is started by the time reference pulse and stopped by the output of CFD 410. The time from the start to the stop of time-to-voltage converter 408 corresponds to the time until a light pulse of scintillation is generated due to fluorescence of sample 403 after the laser beam pulse is output from Argon laser beam source 401 for stimulation.

This time is recorded in multichannel analyzer 409.

The frequency of generation of pulses in each unit time is summed by repetitive layer pulses for use in stimulation so that the time dependence of weak scintillation can be measured.

As described heretofore, the high speed light detection tube in accordance with the present invention provides a planar photoelectron source of transmission type, a photoelectron collection electrode arranged in parallel with the photoelectron source, and an acceleration electrode of transmission type arranged in parallel with the photoelectron source in a space between the photoelectron source and the photoelectron collection electrode; wherein the photoelectron collection electrode and the acceleration electrode of transmission type are kept at an equal potential or near value, and a potential to accelerate the photoelectrons passing through the space is applied to the acceleration electrode of transmission type with respect to the photocathode so that the photoelectron passing through the acceleration electrode of transmission type can be incident on the photoelectron collection electrode at a constant speed or near value.

Photoelectrons are incident on the photoelectron collection electrode at a constant speed or near value, and thus the rise time of the output detected at high speed can be increased to a great extent. The rise time of the output detected in the high speed light detection tube in accordance with the present invention was 55% to 70% when compared with that of the conventional high speed light detection tube.

If the high speed light detection tube of the preferred embodiment is combined with the microchannel plate and if they are housed in a vacuum envelope, weak light pulses of scintillation can be measured.

What is claimed is:

1. A high speed light detection tube comprising of:

a planar photoelectron source of transmission type, a photoelectron collection electrode arranged in parallel with said photoelectron source, and an acceleration electrode of transmission type arranged in parallel with said photoelectron source in a space between said photoelectron source and said photoelectron collection electrode;

wherein said photoelectron collection electrode and said acceleration electrode of transmission type are kept at a substantially equal potential, and a potential to accelerate the photoelectrons passing through said space is applied to said acceleration electrode of transmission type with respect to said planar photoelectron source so that the photoelectrons passing through said acceleration electrode of transmission type can be incident on said photoelectron collection electrode at a substantially constant speed.

2. A high speed light detection tube as claimed in claim 1, wherein said acceleration electrode of transmission type is a mesh electrode.

3. A high speed light detection tube as claimed in claim 1, wherein said photoelectron source is a photocathode formed on the inner wall of a faceplate of a vacuum envelope.

* * * * *